US006877278B2

(12) United States Patent
Kärkkäinen et al.

(10) Patent No.: US 6,877,278 B2
(45) Date of Patent: Apr. 12, 2005

(54) DOOR CLOSING ARRANGEMENT FOR CONTROLLING CLOSURE SEQUENCE OF TURNABLE DOUBLE DOORS

(75) Inventors: Vesa Kärkkäinen, Joensuu (FI); Timo Tallus, Joensuu (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 10/355,392

(22) Filed: Jan. 31, 2003

(65) Prior Publication Data

US 2003/0145522 A1 Aug. 7, 2003

(30) Foreign Application Priority Data

Feb. 1, 2002 (FI) ..... 20020198

(51) Int. Cl.[7] ..... E05C 7/04; E05F 11/34
(52) U.S. Cl. ..... 49/366; 49/359; 16/DIG. 17
(58) Field of Search ..... 49/371, 324, 366, 49/367, 358, 359; 16/DIG. 21, DIG. 17, DIG. 9, DIG. 10, 49, 66

(56) References Cited

U.S. PATENT DOCUMENTS 5,651,216 A * 7/1997 Tillmann ..... 49/367
6,401,393 B2 * 6/2002 Juntunen ..... 49/367
6,449,904 B1 * 9/2002 Paasonen ..... 49/103

* cited by examiner

*Primary Examiner*—Hugh B. Thompson, II
(74) *Attorney, Agent, or Firm*—John Smith-Hill; Smith-Hill and Bedell

(57) ABSTRACT

A door closing arrangement includes a first door closer for closing a first door leaf, the first door closer being positioned on the opposite side of the first door leaf from the its hinge, and a second door closer for closing a second door leaf. The distal end of the pull arm of the first door closer moves along a guide member in a direction towards the second edge of the door frame during movement of the first door leaf from a fully open position to a partially closed position and moves along the guide member in a direction towards the first edge of the door frame during movement of the first door leaf from the partially closed position to a fully closed position. The distal end of the second pull arm move along the guide member during closing of the second door leaf at least initially in a direction towards the first edge of the door frame. A closure sequence control mechanism has a blocking condition in which it prevents movement of the distal end of the second pull arm towards the first edge of the door frame and thereby prevents closing of the second door leaf and has a releasing condition in which it permits movement of the distal end of the second pull arm towards the first edge of the door frame and thereby permits closing of the second door leaf. The closure sequence control mechanism changes from its blocking condition to its releasing position by application of a force directed from the first edge of the door frame towards the second edge of the door frame. A coupling mechanism is coupled to the distal end of the first pull arm when the first door leaf attains the partially closed position and converts movement of the distal end of the first pull arm towards the first edge of the door frame to a force directed towards the second edge of the door frame. A connection piece applies force from the coupling mechanism to the closure sequence control mechanism for changing the closure sequence control mechanism from its blocking condition to its releasing condition.

8 Claims, 4 Drawing Sheets

DOOR CLOSING ARRANGEMENT FOR CONTROLLING CLOSURE SEQUENCE OF TURNABLE DOUBLE DOORS

BACKGROUND OF THE INVENTION

The invention relates to a door closing arrangement for controlling the closure sequence of turnable double doors.

In order to lock together the door leaves of a double door one of the door leaves, a so-called primary door leaf, is preferably provided with a latch bolt. As a consequence, it is necessary for the door leaves to be closed in a certain order so that the primary door leaf provided with the latch bolt is closed after the other door leaf (the secondary door leaf). Thus the spring-loaded latch bolt may, due to its bevelled guide surface, be forced into the lock body in the primary door in order to fully close the primary door. In this position the latch bolt may, forced by the spring, move again to its protruding position, in which it engages the secondary door leaf and locks the door leaves together. Several different approaches for controlling the closure sequence of a double door are known from the prior art.

Depending on the situation the door closers may be installed in a double door so that the door closers are located either on the same side of their respective door leaves as the hinges or on the side opposite to the hinges. In the latter case the problem is that the distal end of the pull arm of the door closer, i.e. the end that is more distant from the door closer mechanism, changes its direction of movement when the door leaf approaches its fully closed position. Consequently, it is difficult to control the closure sequence of the doors and this often makes it necessary to release the primary door even if the secondary door is still somewhat open.

U.S. patent application Publication No. 2001/0025450-A1 discloses an arrangement which is based on the idea that the releasing effect of the secondary door leaf on the closure sequence control mechanism, i.e. the mechanism that prevents premature closing of the primary door leaf, is accomplished by providing a pulling force which makes the blocking member included in the closure sequence control mechanism allow the closing of the primary door leaf. In case the door closers are installed on the same side of the door leaves as the door hinges, whereby no change occurs in the direction of movement of the distal end of the pull arm during the closing phase of the door leaves, the release of the closure sequence control mechanism takes the conventional form of a pushing movement. Such being the case, different arrangements for controlling closure sequences are required, depending on the way in which the door closers are installed.

An embodiment of the present invention provides a novel and improved arrangement to be applied to the case in which the door closers are installed to the respective door leaves on the sides opposite to the door hinges. The invention may be used to provide an arrangement that is simple in construction and has a reliable operation and by which the above-mentioned drawbacks in the prior art arrangements can be eliminated or at least reduced.

SUMMARY OF THE INVENTION

In an embodiment of the invention, the door closers are installed in a manner known per se, to the respective door leaves on the sides opposite to the door hinges, i.e. on the opposite side relative to the opening side of the doors. The distal end of a first pull arm and a connection piece are arranged to cooperate so that in the releasing phase of the closure sequence control mechanism the movement of the distal end of the first pull arm in the direction away from the closure sequence control mechanism is arranged so as to make the connection piece move towards the closure sequence control mechanism.

Thus the arrangement according to the invention utilizes the change of direction of movement so that the primary door leaf is not released until the closing of the secondary door leaf is in such a phase that the distal end of the door closer of the secondary door leaf is moving towards the hinge of the secondary door. The advantage of the arrangement is more reliable closing of the doors, as it is not dependent on the closing speed of the closers in the door leaves. Also, the arrangement is advantageous as it makes it possible to have a simple construction and to provide so-called standard door closers with necessary auxiliary parts at the assembly stage. Further, irrespective of the various ways of installation, the actual closure sequence control mechanism can remain unchanged.

In a preferred embodiment a pulling member, for instance a hook, an L-shaped piece or the like, is arranged in conjunction with the distal end of the first pull arm. Further, the arrangement comprises a transmission member turnably supported to the guide rail, which transmission member affects the connection piece and is arranged to be turned by the pulling member.

If the pulling member is adjustably supported to the pull arm for instance by a screw fastening so that its extension from the pull arm end and/or its position with respect to the longitudinal axis of the pull arm can be changed, it is easier to adapt an arrangement embodying the invention to various applications. In this case for instance variations in door frame depth can be taken into consideration without affecting the moment at which the release of closure sequence control mechanism occurs.

The connection piece preferably comprises an arm member and a guide element provided at one end thereof, whereby the transmission member is arranged to affect said guide element. Then the guide element may be provided with a chamber, inside of which the transmission member is partly located.

It is of advantage with regard to the closure sequence control of door leaves to arrange the pulling member so as to turn the transmission member in a phase when the first door leaf is no longer more than about 15° open.

BRIEF DESCRIPTION OF THE DRAWINGS

In the following the invention is described by way of example with reference to the attached drawings, in which.

DETAILED DESCRIPTION

Figure 1:
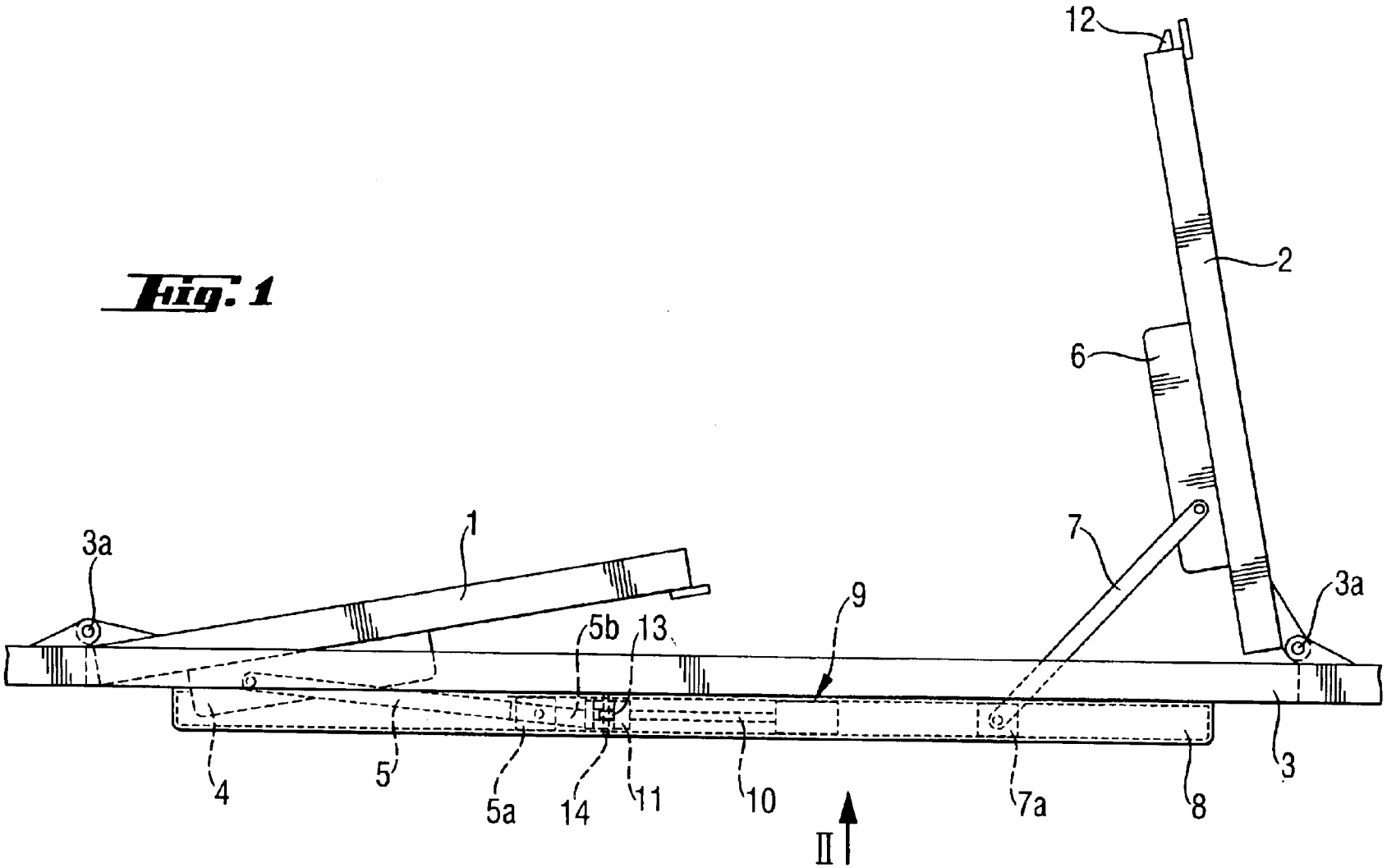
FIG. 1 is a schematic top view of a door closer arrangement for double doors embodying the invention, the door leaves being shown in an open position.
Figure 2:
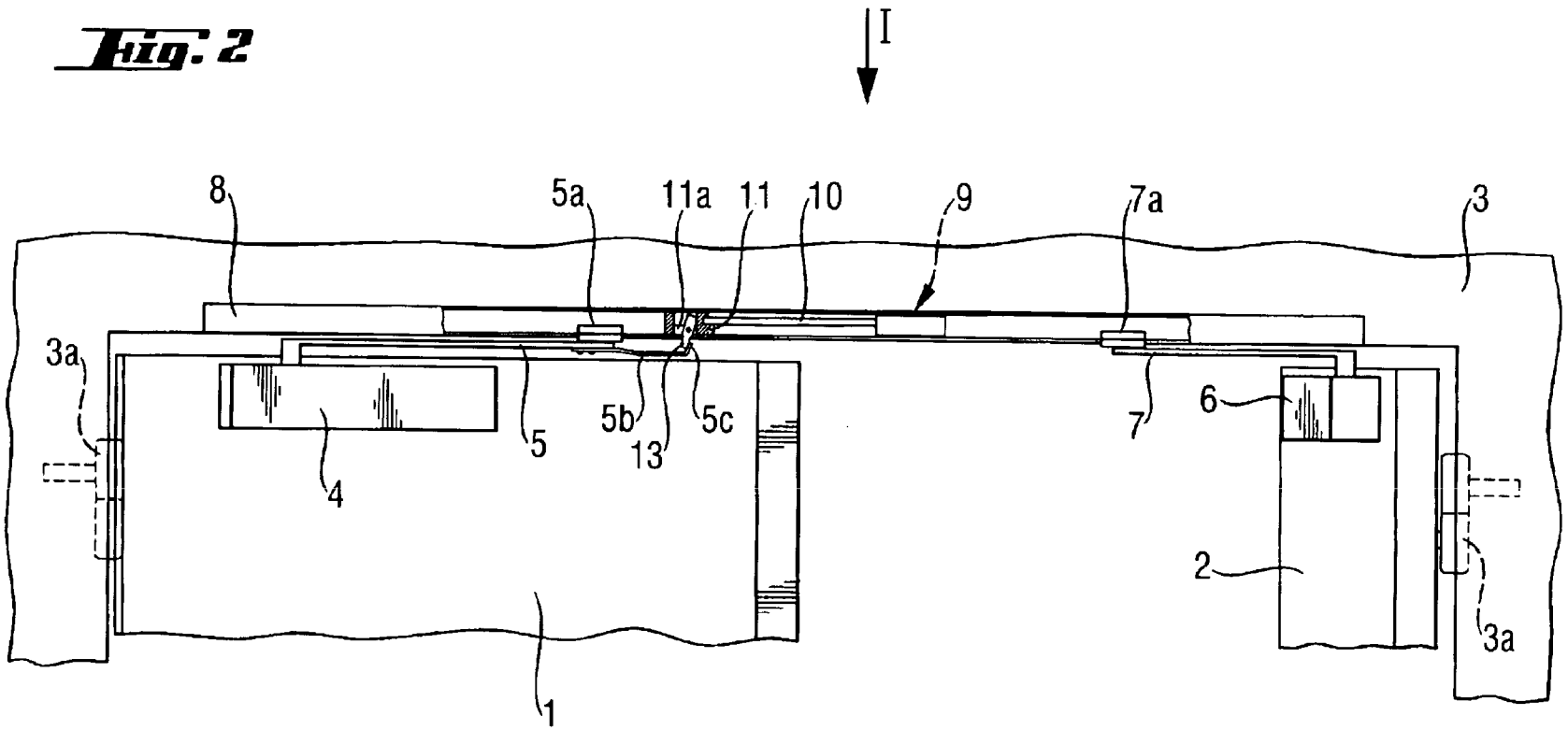
FIG. 2 is a side view of the arrangement shown in FIG. 1, the door leaves being shown in a partly open position.

In the drawings the reference numbers 1 and 2 designate two door leaves of a turnable double door which are hingedly-mounted to a door frame 3 by means of hinges 3*a*. The door leaf 1 is provided with a door closer 4 having a pull arm 5, and the door leaf 2 is provided with a door closer 6 having a pull arm 7. The door closers are fitted to their respective door leaves on the side opposite to the hinges 3*a*, i.e. on the side opposite to the opening side of the doors, whereby an advantageous geometry is accomplished, such that during closing movement of the door leaves, i.e. monotonic movement of the door leaves from an open position to a fully closed position, the distal ends 5*a*, 7*a* of the pull arms 5, 7 first move away from the hinges of the respective door leaves and the ends 5*a*, 7*a* subsequently move towards the respective hinges during the end phase of the closing movement. Preferably, the geometry is arranged so that the direction of movement of the distal end of a pull arm changes when the opening angle of the door leaf, i.e. the angular movement that remains before the door leaf is fully closed, is about 15°. The change of the direction of movement may be chosen by a suitable arrangement to be in the range from 15° to almost 0°, but the invention cannot be reliably applied if the angular movement after the change in direction is too small. This change in direction occurs when the fulcrum point of the arm, when the door is being closed, crosses the line drawn through the tipping center of the hinge 3*a* and the distal end 5*a* of the arm. By this arrangement it is possible to have a decreased closing angle for the first door leaf 1, whereby the closure sequence control mechanism releases the second door leaf 2 to be closed. Thus the door leaves are closed in the correct order independent of the speed control of the door closers.

Above the door leaves, supported to the upper part of the door frame 3 (not shown more closely) there is a guide rail 8 or the like guiding the distal ends 5*a* and 7*a* of the pull arms 5 and 7 during the turning movements of the door leaves. The door leaf 1 is a so-called secondary door leaf and the door leaf 2 is a so-called primary door leaf, which is provided with a latch bolt 12 in order to lock the door leaves to each other. Thus the secondary door leaf must always close always first. A closure sequence control mechanism 9 is located in the guide rail 8 to ensure that the door leaf 2 provided with a latch bolt 12 is closed only after the door leaf 1 has closed.

The arrangement includes a connection piece movable in the guide rail 8 and comprising an arm member 10 having, at one end, a guide element 11 arranged to cooperate with the end 5*a* of the pull arm of the first door leaf 1, as will be described in more detail below. The second end of the arm member 10 influences the closure sequence control mechanism 9, which can have several embodiments not shown in detail in the drawings. One preferable embodiment of the closure sequence control mechanism is disclosed in co-pending U.S. patent application Ser. No. 10/141,562.

In association with the end 5*a* of the pull arm 5 of the door closer in the secondary door leaf 1 there is arranged a pulling member 5*b* having a bent hook-shaped or L-shaped part 5*c*. The actual pull arm end 5*a*, which cooperates directly with the guide rail 8, is turnably supported to the pull arm 5 by means of a pin 5*d*. The pulling member 5*b*, in turn, is attached to the pull arm 5 by means of screws 15. Therefore the pulling member 5*b* is provided with guide grooves or slots 5*e* and 5*f* for the screws 15 allowing the movement of the pulling member 5*b* in the longitudinal direction of the pull arm 5 in order to adjust the extension of the pulling member 5*b* relative to the pull arms. By making one of the guide grooves or slots 5*e* or 5*f* wider than the screw 15 the pulling member 5*b* may even be installed, if needed, at an angle with respect to the longitudinal axis of the pull arm 5. Thus the circumstances dependent on various installations positions, such as the variations in frame depth, can be taken into consideration without affecting the operation of the closure sequence control mechanism 9, especially the timing of its releasing action. Further, the arrangement makes it possible to use a standard door closer and pull arm, as it is possible to install the pulling member 5*b* to the pull arm later on.

The guide element 11 is shaped so as to define a chamber 11*a*. A transmission member 13, which is turnably supported to the guide rail 8 by means of a pin 14, is located in the chamber 11*a*. The transmission member 13 is on the one hand in cooperation with the pulling member 5*b* and on the other hand with a guide surface 11*b* of the guide element 11.

Figure 3:
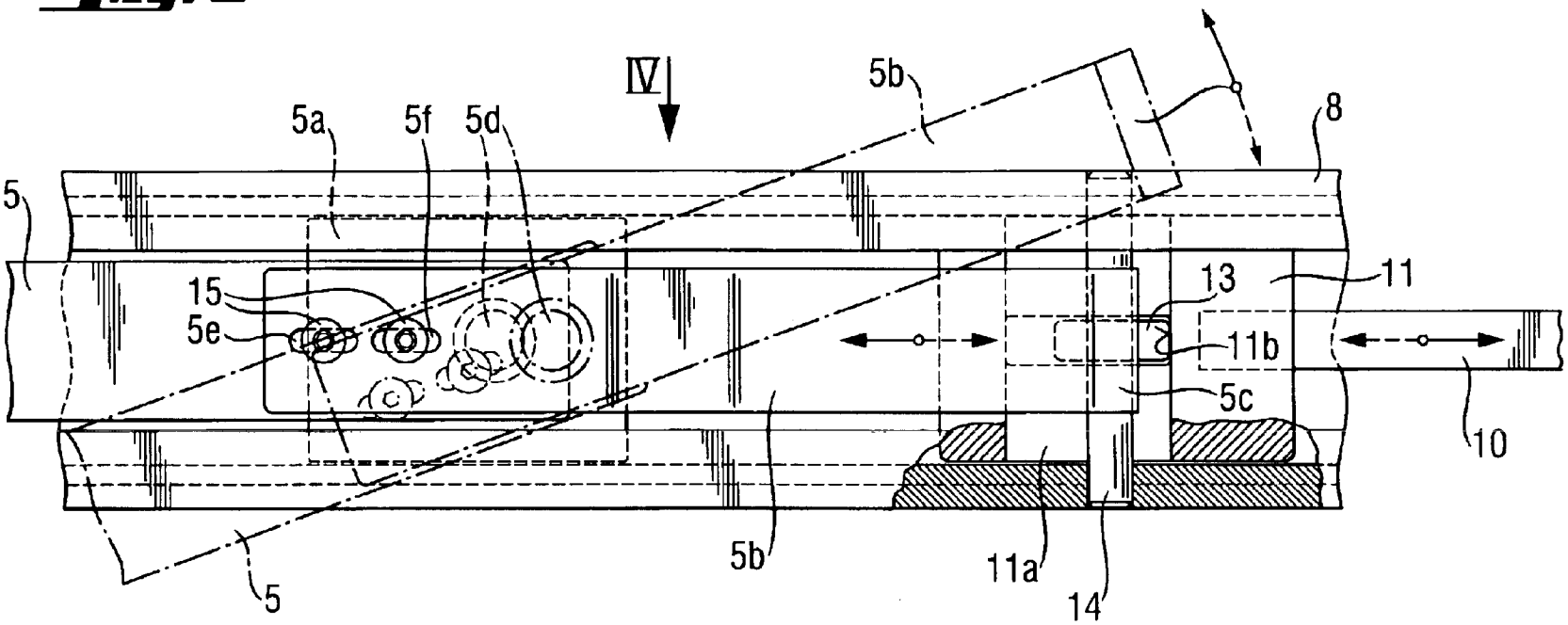
FIG. 3 is a partial enlargement of the releasing arrangement of the closure sequence control mechanism shown in FIG. 1 seen from below the guide rail.
Figure 4:
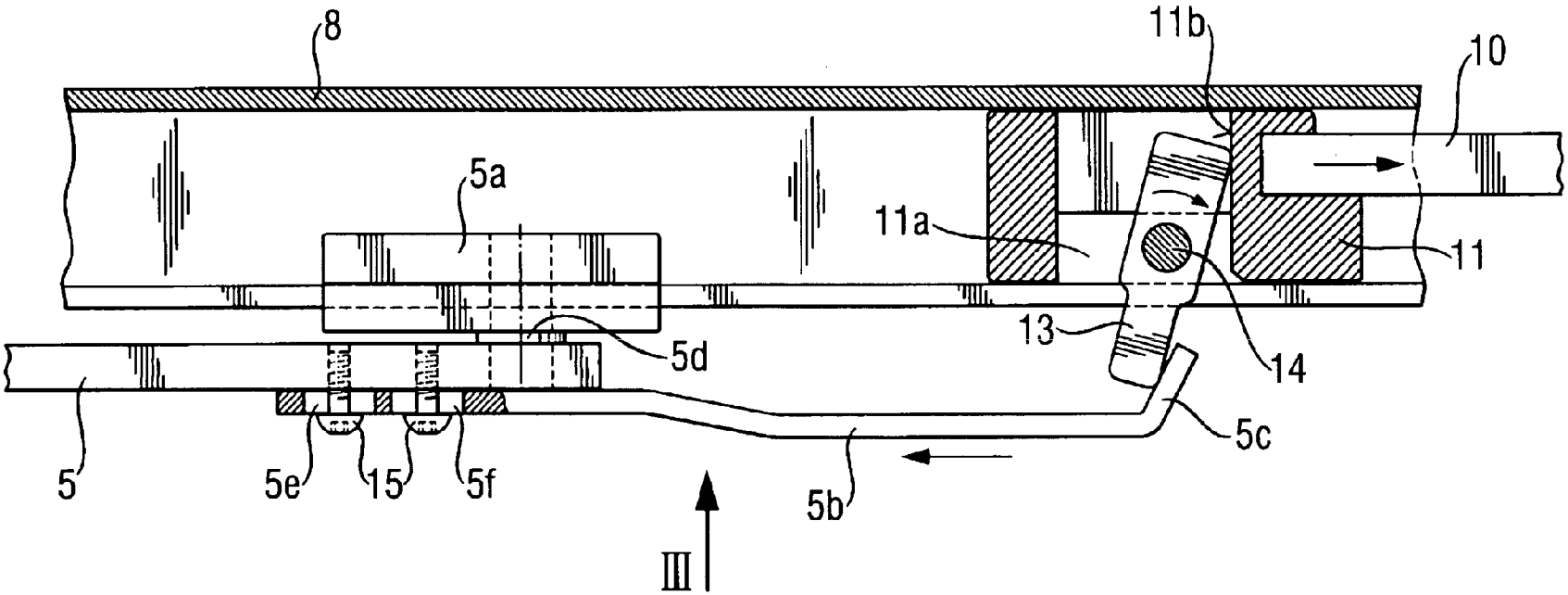
FIG. 4 is side view in section of the partial enlargement of FIG. 3.

With particular reference to FIGS. 3 and 4 the releasing arrangement of the closure sequence control means operates as follows. In order to close the door leaf 2 it is necessary to first turn the door leaf 1 so that the end 5*a* of the pull arm 5 moves in the guide rail 8 away from the hinge of the door leaf 1, towards the guide element 11. At the same time the pulling member 5*b*, 5*c*, being an extension of the end 5*a*, turns to the guide element 11 and the transmission member 13. When the door leaf 1 is further closed, the end 5*a* of the pull arm 5 and the pulling member 5*b*, 5*c* change their direction so that they start moving towards the hinge of the door leaf 1 in the direction of the arrow shown in FIG. 4. Then the pulling member 5*b*, 5*c* turns the connection piece 13, which presses against the guide surface 11*b* and thus moves the guide element 11 and the arm member 10 towards the door leaf 2 and the closure sequence control mechanism 9. Consequently, the closure sequence control mechanism releases, in a manner known per se (not shown in the drawings), the end 7*a* of the pull arm of the second door leaf 2, whereby the door leaf 2 is then allowed to close. Thus a selective mechanical coupling is provided between the connection piece and the pull arm 5.

The above-described combination of a hook-shaped pulling member and a turnable transmission lever in conjunction with the end 5*a* of the pull arm and the guide element 11 may in practice be implemented in many ways. The hook-shaped part may be shaped in various ways and it can also be replaced by different kinds of mechanisms providing a selective mechanical coupling, by which the arm member 10 of the connection piece can accomplish a pushing movement that releases the closure sequence control mechanism.

Instead of using the above-described adjustable fastening in the pulling member 5*b* it is possible, if so desired, to use even pulling members 5*b* of various lengths, or the pulling member 5*b* may be provided with a number of separate openings for the screws 15, whereby the length of the pulling member 5*b* may be varied by using various openings in order to change the supporting point of the pulling member 5*b*. Also, these arrangements make it possible to take the variations in frame depth into consideration.

Thus, the invention is not limited to the above-described application, but several other modifications are conceivable within the scope of the appended claims.

What is claimed is:

1. A door closing arrangement for first and second door leaves that are pivotable with respect to a door frame having first and second edges, the first door leaf being attached to the door frame at the first edge by a first hinge means and the second door leaf being attached to the door frame at the second edge by a second hinge means, the door closing arrangement comprising:

a first door closer and a first pull arm for closing the first door leaf the first pull arm having a distal end and the first door closer adapted to be positioned on the opposite side of the first door leaf from the first hinge means, a second door closer and a second pull arm for closing the second door leaf, the second pull arm having a distal end, an elongate guide member for guiding movement of the distal ends of the pull arms, the distal end of the first pull arm moving along the guide member in a direction towards the second edge of the door frame during movement of the first door leaf from a fully open position to a partially closed position and moving along the guide member in a direction towards the first edge of the door frame during movement of the first door leaf from the partially closed position to a fully closed position, and the distal end of the second pull arm moving along the guide member during closing of the second door leaf at least initially in a direction towards the first edge of the door frame, a closure sequence control mechanism having a blocking condition in which it prevents movement of the distal end of the second pull arm towards the first edge of the door frame and thereby prevents closing of the second door leaf and having a releasing condition in which it permits movement of the distal end of the second pull arm towards the first edge of the door frame and thereby permits closing of the second door leaf, the closure sequence control mechanism changing from its blocking condition to its releasing condition by application of a force directed from the first edge of the door frame towards the second edge of the door frame, a coupling mechanism that is coupled to the distal end of the first pull arm when the first door leaf attains the partially closed position and converts movement of the distal end of the first pull arm towards the first edge of the door frame to a force directed towards the second edge of the door frame, and a connection piece for applying the force from the coupling mechanism to the closure sequence control mechanism for changing the closure sequence control mechanism from its blocking condition to its releasing condition.

2. The door closing arrangement according to claim 1, wherein the coupling mechanism includes a pulling member arranged in conjunction with the distal end of the first pull arm, and a transmission member that is turnably supported to the guide member and affects the connection piece and is arranged to be turned by the pulling member.

3. The door closing arrangement according to claim 2, wherein the pulling member in adjustably supported to the first pull arm so that its extension from the distal end of the first pull arm can be changed.

4. The door closing arrangement according to claim 2, wherein the pulling member is adjustably supported to the first pull arm so that its angular position with respect to the longitudinal axis of the first pull arm can be changed.

5. The door closing arrangement according to claim 2, wherein the connection piece comprises an arm member and a guide element provided at one end thereof, the transmission member being arranged to affect said guide element.

6. The door closing arrangement according to claim 5, wherein the guide element defines a chamber and the transmission member is partly located in the chamber.

7. The door closing arrangement according to claim 2, wherein the pulling member is arranged to turn the transmission member in a phase when the first door leaf is no longer more than about 15° open.

8. A door installation including:

a door frame having first and second edges, first and second door leaves that are pivotable with respect to the door frame, the first door leaf being attached to the door frame at the first edge by a first hinge means and the second door leaf being attached to the door frame at the second edge by a second hinge means, a first door closer and a first pull arm for closing the first door leaf, the first pull arm having a distal end and the first door closer being positioned on the opposite aide of the first door leaf from the first hinge means, a second door closer and a second pull arm for closing the second door leaf, the second pull arm having a distal end, an elongate guide member for guiding movement of the distal ends of the pull arms, the distal end of the first pull arm moving along the guide member in a direction towards the second edge of the door frame during movement of the first door leaf from a fully open position to a partially closed position and moving along the guide member in a direction towards the first edge of the door frame during movement of the first door leaf from the partially closed position to a fully closed position, and the distal end of the second pull arm moving along the guide member during closing of the second door leaf at least initially in a direction towards the first edge of the door frame, a closure sequence control mechanism having a blocking condition in which it prevents movement of the distal end of the second pull arm towards the first edge of the door frame and thereby prevents closing of the second door leaf and having a releasing condition in which it permits movement of the distal end or the second pull arm towards the first edge of the door frame and thereby permits closing of the second door leaf, the closure sequence control mechanism changing from its blocking condition to its releasing condition by application of a force directed from the first edge of the door frame towards the second edge of the door frame, a coupling mechanism that is coupled to the distal end of the first pull arm when the first doer leaf attains the partially closed position and converts movement of the distal end of the first pull arm towards the first edge of the door frame to a force directed towards the second edge of the door frame, and a connection piece for applying the force from the coupling mechanism to the closure sequence control mechanism for changing the closure sequence control mechanism from its blocking condition to its releasing condition.

* * * * *